US007683531B2

(12) United States Patent
Lin et al.

(10) Patent No.: US 7,683,531 B2
(45) Date of Patent: Mar. 23, 2010

(54) TRIODE FIELD EMISSION DISPLAY

(75) Inventors: Biing-Nan Lin, Hsinchu (TW); Cheng-Chung Lee, Hsinchu (TW); Yu-Yang Chang, Hsinchu (TW); Wei-Yi Lin, Hsinchu (TW)

(73) Assignee: Industrial Technology Research Institute, Hsinchu (TW)

( * ) Notice: Subject to any disclaimer, the term of this patent is extended or adjusted under 35 U.S.C. 154(b) by 700 days.

(21) Appl. No.: 11/195,790

(22) Filed: Aug. 3, 2005

(65) Prior Publication Data

US 2006/0238105 A1 Oct. 26, 2006

(30) Foreign Application Priority Data

Apr. 20, 2005 (TW) ..... 94112626 A

(51) Int. Cl.
*H01J 1/62* (2006.01)
*H01J 63/04* (2006.01)

(52) U.S. Cl. ..... 313/497; 313/495; 313/496; 313/310; 315/169.3

(58) Field of Classification Search ..... 313/495–497, 313/309–311
See application file for complete search history.

(56) References Cited

U.S. PATENT DOCUMENTS 5,214,347 A * 5/1993 Gray ..... 313/355
5,804,909 A * 9/1998 Nilsson et al. ..... 313/309
6,278,228 B1 8/2001 Iwase et al.
6,359,383 B1 * 3/2002 Chuang et al. ..... 313/496
6,672,925 B2 * 1/2004 Talin et al. ..... 445/49
6,819,041 B2 * 11/2004 Kajiwara ..... 313/496
7,129,626 B2 * 10/2006 Kastalsky et al. ..... 313/309
7,429,820 B2 * 9/2008 Howard et al. ..... 313/495
2001/0024084 A1 * 9/2001 Kajiwara ..... 313/486
2003/0178934 A1 * 9/2003 Jeong et al. ..... 313/495
2003/0184357 A1 * 10/2003 Dijon et al. ..... 327/301
2004/0004429 A1 * 1/2004 Oh et al. ..... 313/495

FOREIGN PATENT DOCUMENTS

JP 2000-251617 9/2000
JP 2000-2777001 10/2000
TW 434626 5/2001

* cited by examiner

*Primary Examiner*—Sikha Roy
(74) *Attorney, Agent, or Firm*—Harness, Dickey & Pierce, P.L.C.

(57) ABSTRACT

A triode field emission display is provided. It utilizes the electrical characteristics that an edge structure may raise the electric field intensity to expose an edge of a cathode plate through an opening of a gate layer, thereby forming the edge structure at an emitter to raise the electric field intensity. Therefore, reduction of driving voltage is achieved.

17 Claims, 9 Drawing Sheets

TRIODE FIELD EMISSION DISPLAY

BACKGROUND

1. Field of Invention

The invention relates to a field emission display (FED), and more particularly to a field emission display with a triode structure.

2. Description of the Related Art

In a field emission display (FED), voltage is applied to a cathode and a gate electrode in a vacuum to supply an electric field for inducing electrons at the tip of a material, and then the field-emitted electrons left from the cathode plate are accelerated toward the anode (since positive voltage on the anode attracts) and collide with phosphors, thereby emitting luminescence.

Referring to FIG. 1, the FED has an anode plate 10 and a cathode plate 20 between which a vacuum cavity is formed. In the anode plate 10, an anode electrode layer 12 and a luminescent layer 13 are formed under a glass substrate 11 in order. In the cathode plate 20, a cathode electrode layer 22 is formed on a glass substrate 21, and a field-emitted array 23 having a two dimension distributions is disposed on the cathode electrode layer 22. On each array unit is disposed a gate layer 24 having a hole 25, inside which there is a metallic taper on the cathode electrode layer 22, and the gate layer 24 and the sides of the metallic taper are separated by an insulation layer 26. To achieve the array property of the above-mentioned structure, the structure needs to be implemented through expensive lithography and deposition, and the sizes of finished displays are seriously limited. Therefore, new materials and new processes have been developed.

As shown in FIG. 2, an FED disclosed in U.S. Pat. No. 6,359,383 not only utilizes a nanotube instead of a conventionally electronic emitter, but also provides a new structure of the FED. It includes an anode plate 30, a cathode plate 40 separated from the anode plate 30 at a distance and comprising a cathode electrode layer 41, a resistive layer 42 and a nanotube emitter 43, which is disposed on the top layer of the cathode plate 40 to perform the field emission in sequence, an insulation substrate 50 on which the cathode plate 40 is disposed, a gate layer 60 disposed at two sides of the nanotube emitter 43 on the cathode plate 40, and a dielectric substrate 70 separating the cathode plate 40 from the gate layer 60 to drive the nanotube emitter 43 for emitting electrons, thereby having lower requirements for driving voltage.

Although the structure of the FED provided in the prior art can be implemented through a simple thin film printing technique to reduce cost, a preferable solvent should exist to further reduce the driving voltage of the FED for accelerating the development of the driving system.

SUMMARY

Accordingly, the invention relates to a triode field emission display for reducing a driving voltage. It utilizes the electrical characteristics that an edge structure may raise the electric field intensity, to substantially solve the problems in the prior art.

To achieve these and other advantages and in accordance with the purpose of the invention, as embodied and broadly described, a triode field emission display comprises an insulation substrate, a cathode plate, a gate layer, a dielectric layer and an anode plate. The insulation substrate acts as a cathode substrate. The cathode plate is disposed on the insulation substrate, and the gate layer disposed above the cathode plate has a first opening to expose the edge of the cathode plate such that the electrons are excited from the cathode plate. The dielectric layer separates the cathode plate from the gate layer, and the anode plate is disposed above the gate layer so that the excited electrons emit and collide with the anode plate.

The anode plate comprises a transparent substrate, an anode electrode layer disposed under the transparent substrate, and a light emitting layer disposed under the anode electrode. The cathode plate is formed with a cathode electrode layer, a resistive layer formed on the cathode electrode layer and an emitter formed on the resistive layer. The emitter of the cathode plate emits the electrons as voltages at the anode plate and the gate layer attract, and then the electrons collide with the light emitting layer on the anode plate, such that the light emitting layer excites light. The light from the light emitting layer travels through the transparent substrate and is emitted.

In a triode field emission display according to invention, there is an edge structure at the emitter to enhance the electric field intensity. Further, the cathode plate may have a second opening, and the second opening and the cathode plate surrounded the second opening are entirely or partially exposed through the first opening—thereby the same purpose is achieved.

BRIEF DESCRIPTION OF THE DRAWINGS

The invention will become more fully understood from the detailed description given herein below, which is for illustration only, and thus is not limitative of the invention, wherein.

DETAILED DESCRIPTION OF THE INVENTION

Figure 1:
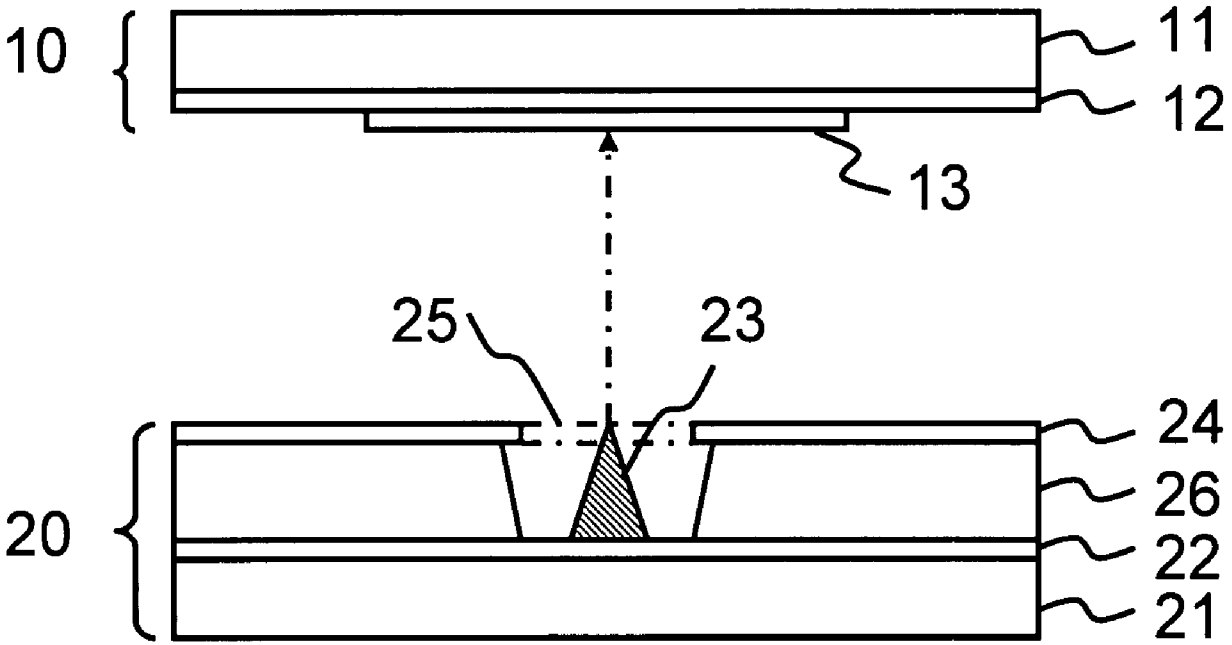
FIG. 1 (PRIOR ART)
FIG. 1 shows a basic structure of a conventional field emission display.
Figure 2:
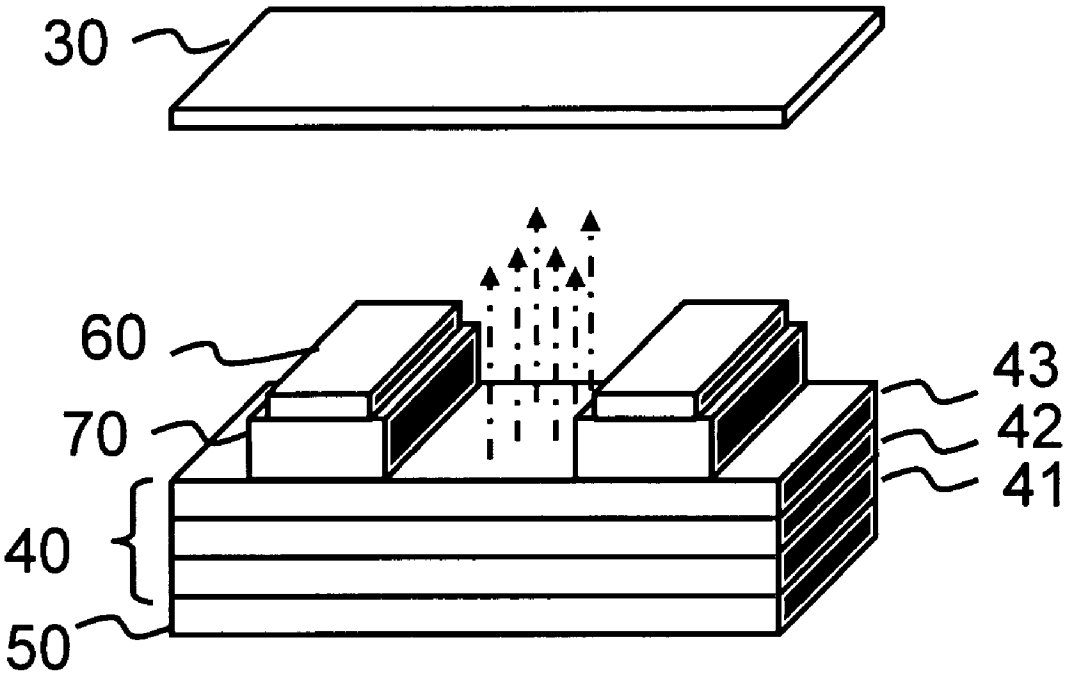
FIG. 2 (PRIOR ART)
FIG. 2 is a schematic view showing another conventional field emission display.
Figure 3A:
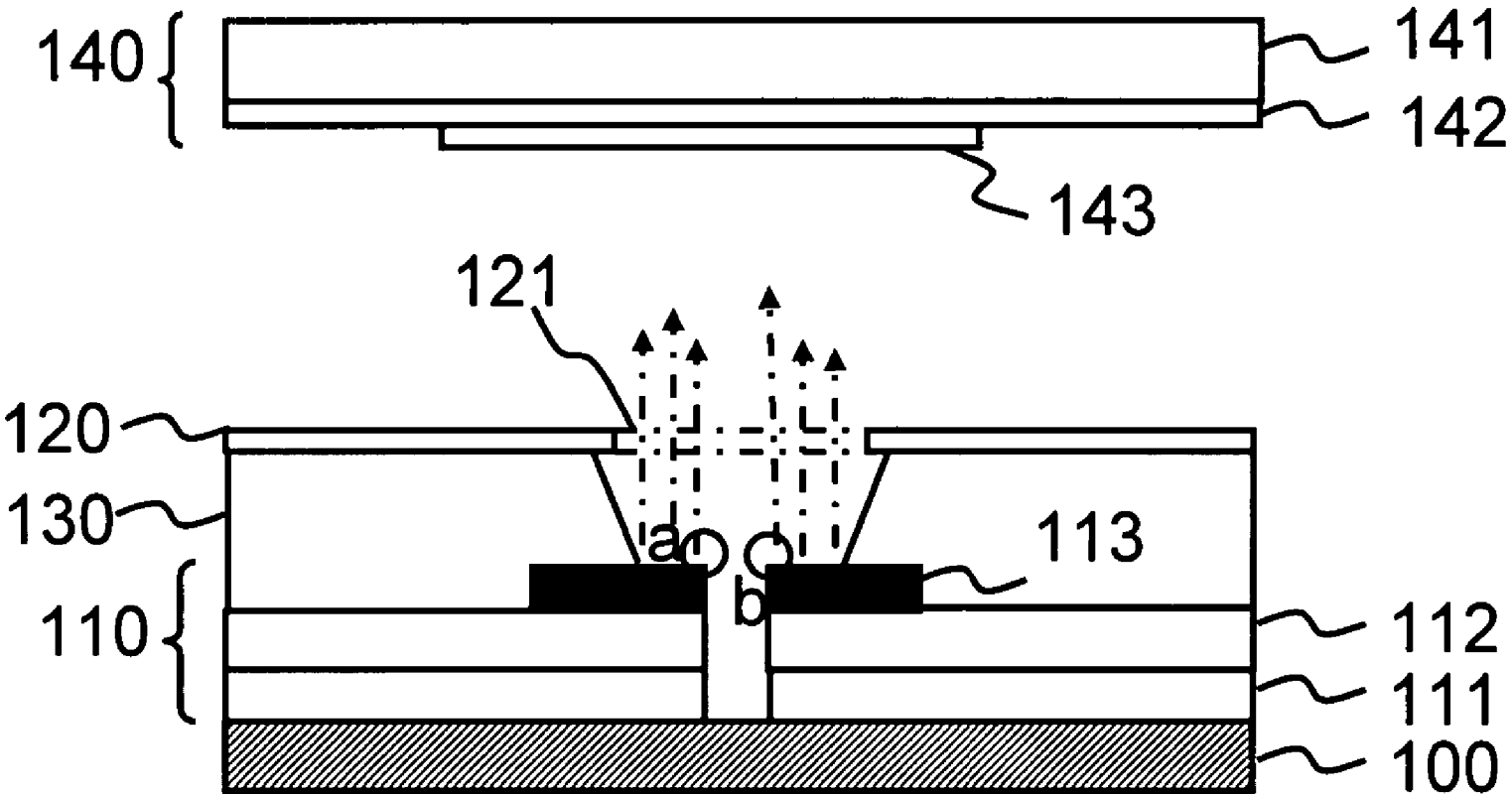
FIGS. 3A and 3B are a cross-sectional view and an upward view showing a triode field emission display according to a first embodiment of the invention, respectively.
Figure 3B:
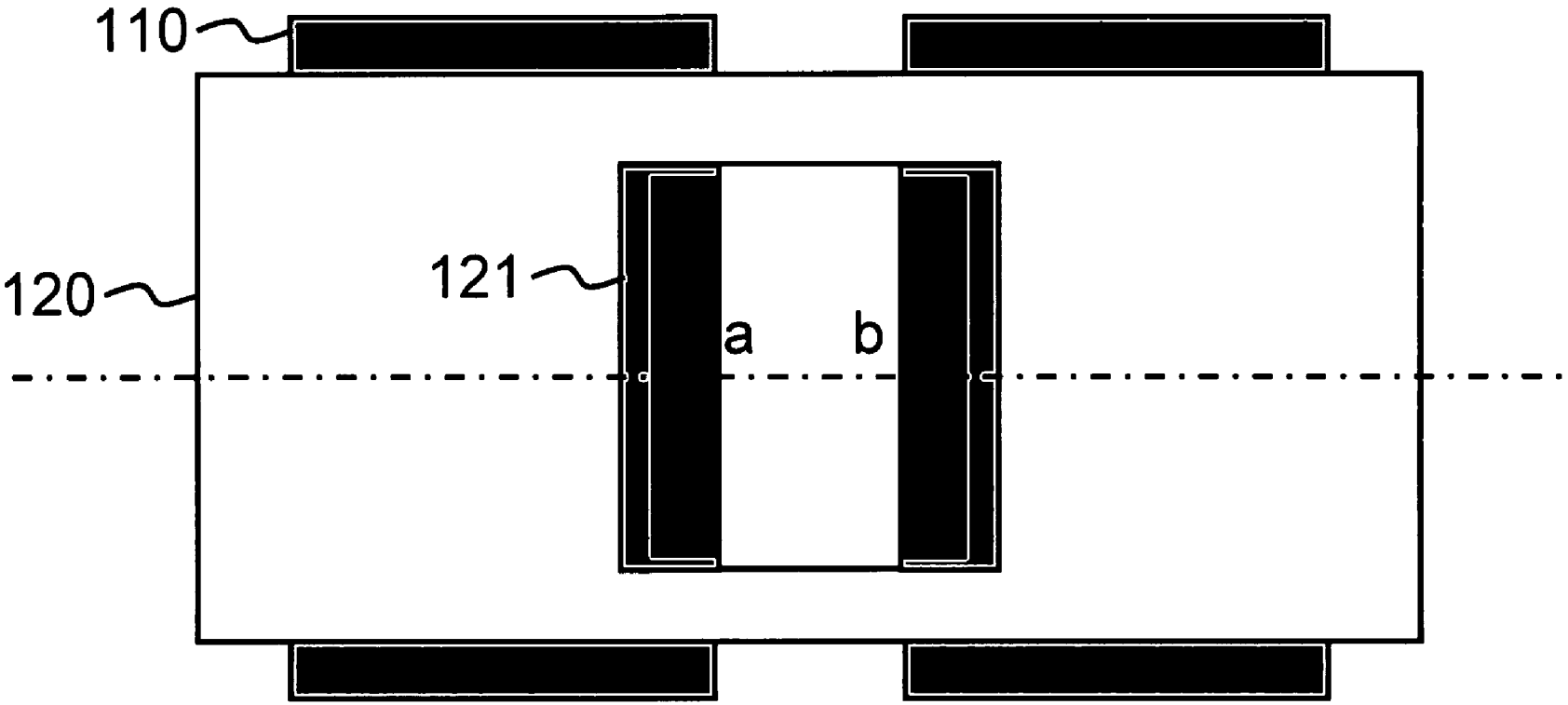

Referring to FIGS. 3A and 3B, a triode field emission display according to a first embodiment of the invention includes an insulation substrate 100, two cathode plates 110, a gate layer 120, a dielectric layer 130 and an anode plate 140. The insulation substrate 100 as a cathode substrate may be made of glass substrate, plastic substrate or other suitable material.

Both cathode plates 110 are disposed on the insulation substrate 100, and each cathode plates 110 is formed with a cathode electrode layer 111, a resistive layer 112 and an emitter 113. The resistive layer 112 is formed on the cathode electrode layer 111. Each emitter 113 provided as a cathode emitter is connected in series, and coupled to a first voltage level. The emitter 113 is made of a conductive material, which is flaky, clubbed or tubular, is coated with carbon materials, and is formed on the resistive layer 112. The carbon material is selected from a nano carbon material, a diamond, a diamond-like carbon material and the like.

The gate layer 120 disposed above the cathode plates 110 has a first opening 121 pierced through the gate layer 120 to expose the edges a and b of both cathode plates 110, and is coupled to second voltage level, slightly higher than the first voltage level, to induce the emitters 113 of the cathode plates 110 to emit electrons. The gate layer 120 may be made of a conductive material, such as a refractory metal, like molybdenum (Mo), niobium (Nb), chromium (Cr), hafnium (Hf) or their composites or carbides. Furthermore, the dielectric layer 130 is below the gate layer 120 to separate the gate layer 120 from the cathode plates 110.

The anode plate 140 is formed above the gate layer 120 at a distance, and comprises a transparent substrate 141, an anode electrode layer 142 and a light emitting layer 143. In this case, the transparent substrate 141 is a glass substrate. A transparent anode electrode layer 142 is formed under the transparent substrate 141 and coupled to a third voltage level, where the third voltage level is higher than the first and second voltage levels. The anode electrode layer 142 is made of indium tin oxide (ITO) or tin oxide (TO). The light emitting layer 143 is formed below the anode electrode layer 142. In this case, the light emitting layer 143 is a fluorescent layer or a phosphorous layer.

Accordingly, in a vacuum, the emitters 113 emit electrons. An electric field is produced as the second and third voltage levels attract, and then the electrons collide with the light emitting layer 143 on the anode plate 140 such that the light emitting layer 143 excites light traveling through the transparent substrate 141. The light is then emitted. In order for the electrons to be emitted by the emitters 113 of the foregoing cathode plates 110, they collide with the light emitting layer 143, thereby exciting light. The anode plate 140 must be applied with a sufficient third voltage level to induce the ample electric field. Since the gate layer 120 is closer to the emitters 113 than the anode plate 140, the electrons are more easily excited from the emitters when the second voltage level is applied, such that the FED is driven by lower driving voltage. In this embodiment, the edge of the emitter 113 is exposed so as to create higher electric field intensity, thereby reducing the driving voltage substantially.

Figure 4A:
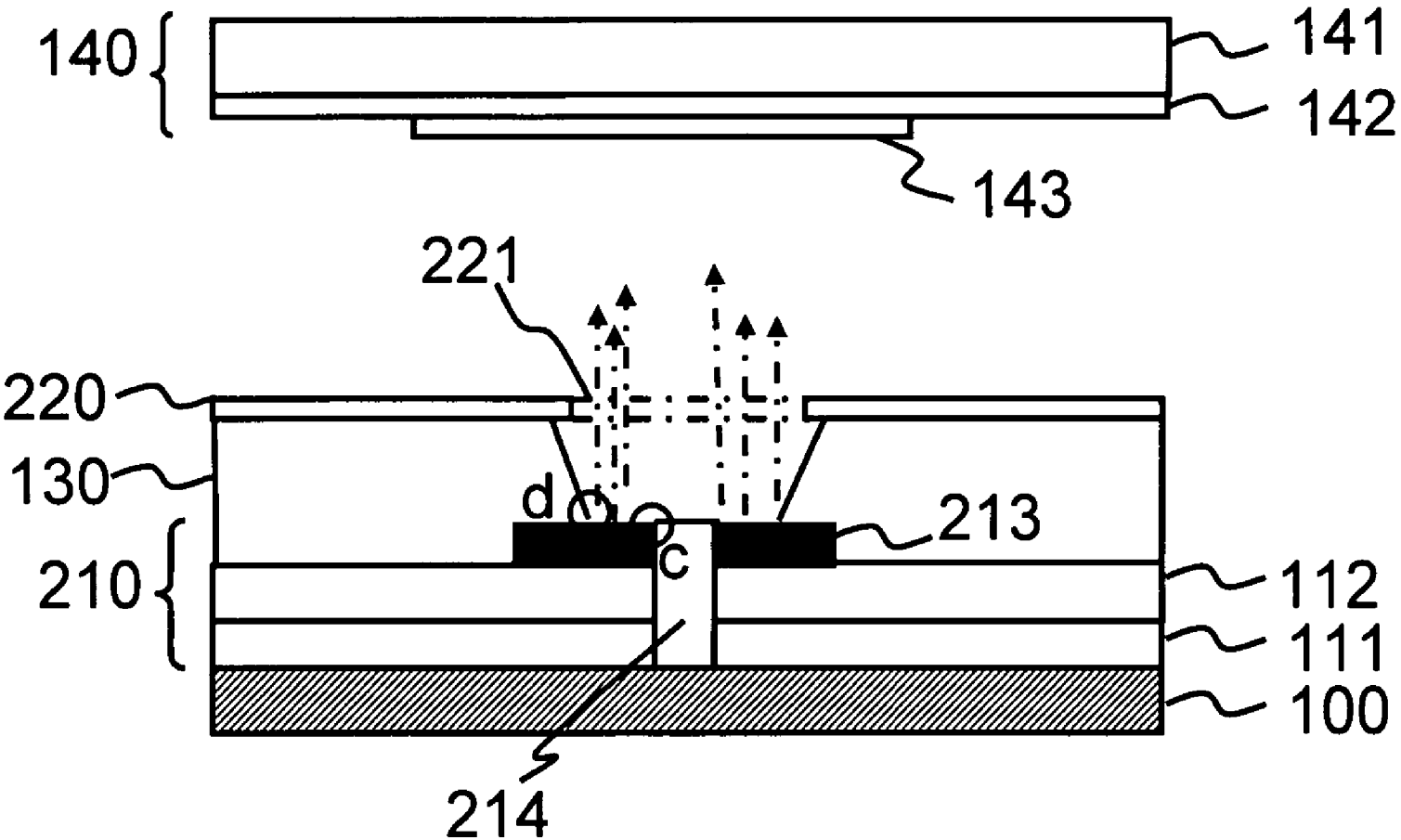
FIGS. 4A and 4B are a cross-sectional view and an upward view showing a triode field emission display according to a second embodiment of the invention, respectively.
Figure 4B:
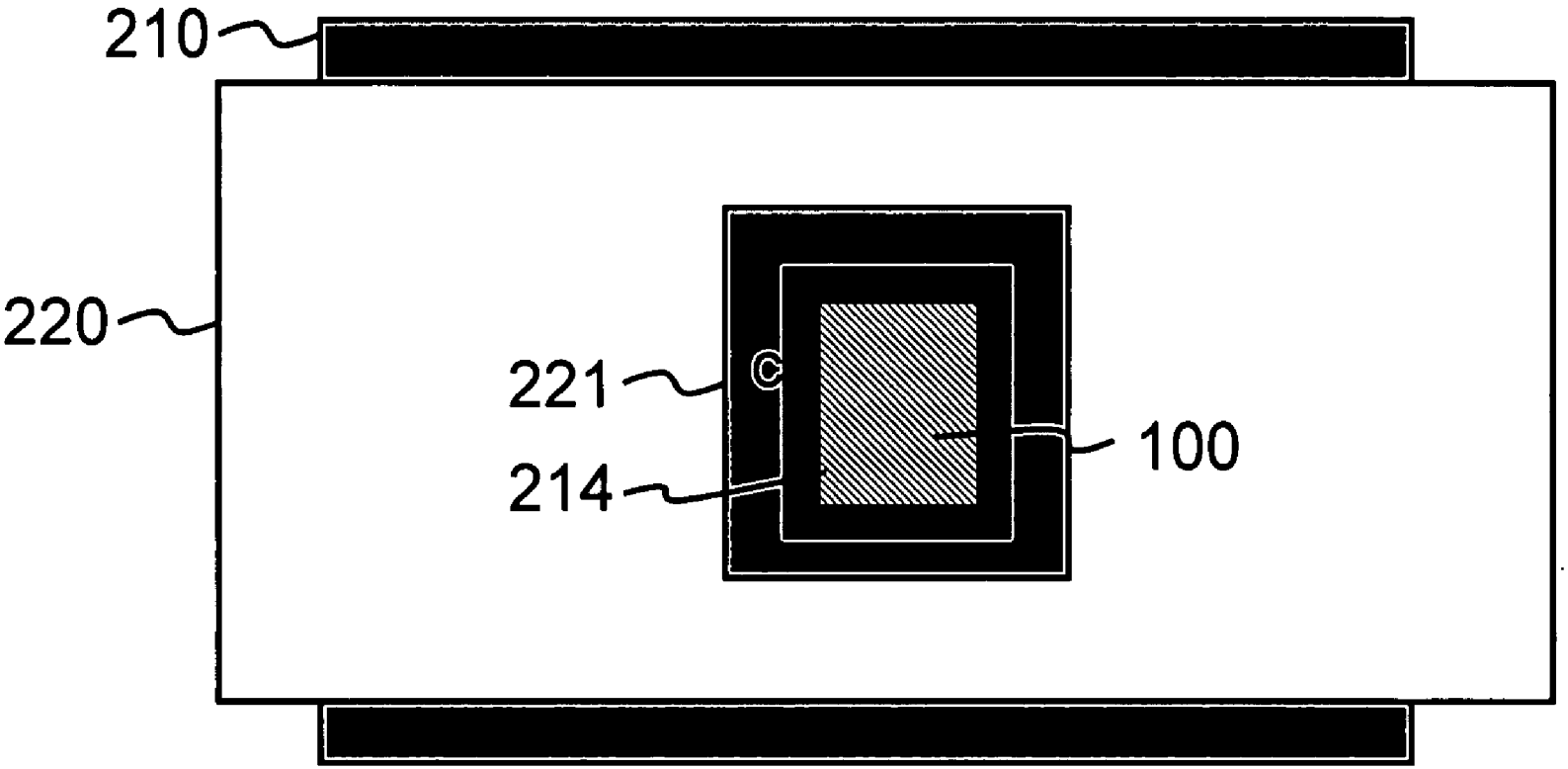

FIGS. 4A and 4B show a triode field emission display according to a second embodiment of the invention. The cathode plate 210 has a second opening 214 to expose a section of the cathode plate 210 surrounded the second opening 214, such that there is an edge c at the emitter 213. In actual tests of the electric field distribution, it is realized that the electric field intensity at the edge c of the emitter 213 (about 5.37 volts per micrometer) is 2 times that at the non-edge d (about 2.55 volts per micrometer). As a result, the triode field emission display according to the invention enables effective increase in the electric field. Therefore, the objective of reducing the driving voltage is achieved.

Figure 5A:
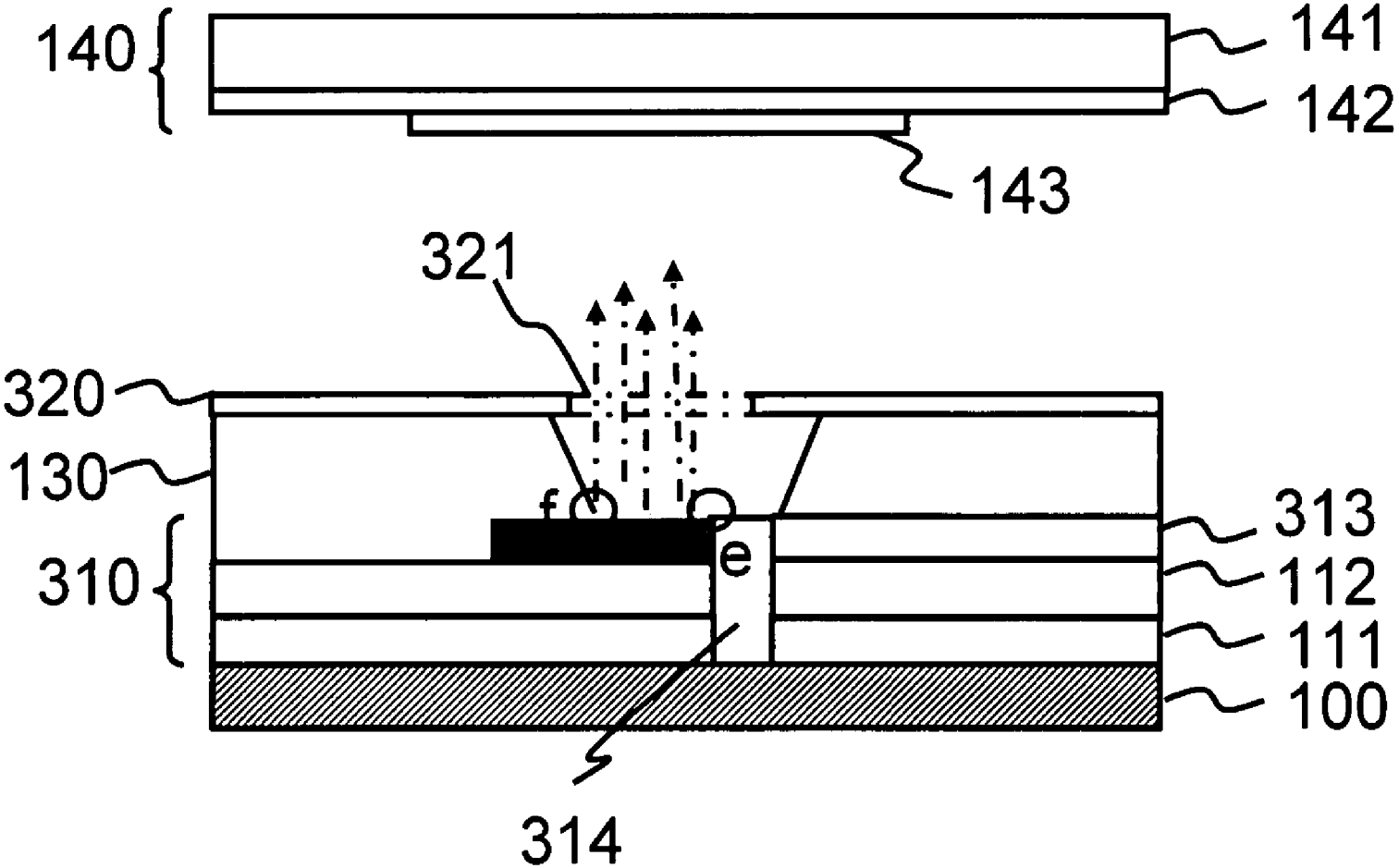
FIGS. 5A and 5B are a cross-sectional view and an upward view showing a triode field emission display according to a third embodiment of the invention, respectively.
Figure 5B:
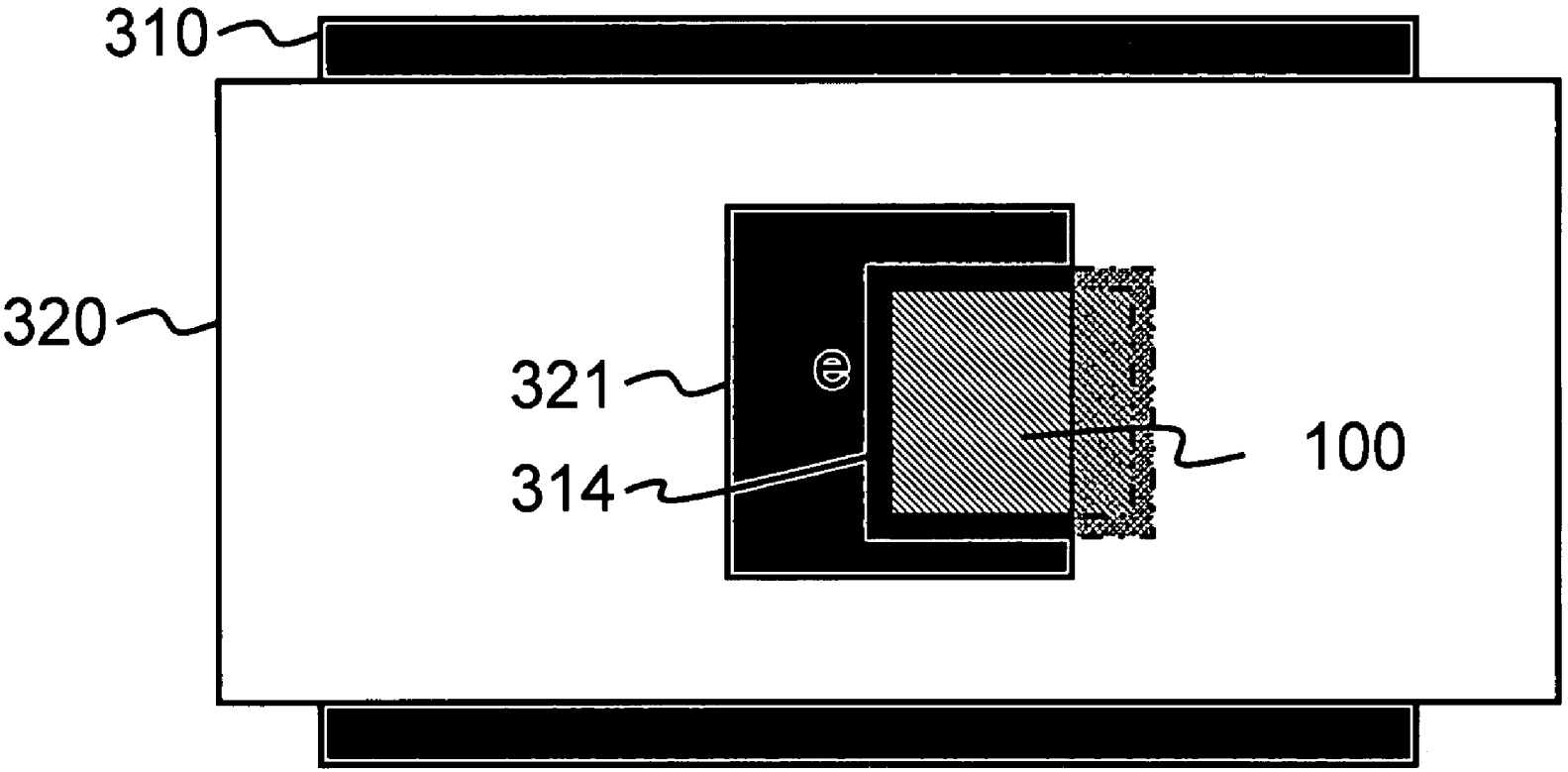

Besides, as shown in FIGS. 5A and 5B, in a third embodiment of the invention, the first opening 321 of the gate layer 320 of the triode field emission display only exposes a section of the second opening 214 and a section of the cathode plate 210 surrounded the section of the second opening 214, thereby acquiring the emitter 213 with an edge e to raise the electric field and reduce the driving voltage. Moreover, in actual tests of the electric field distribution, it is realized that the electric field intensity at the edge c of the cathode plates 310 is far higher than that at the non-edge f.

Figure 5C:
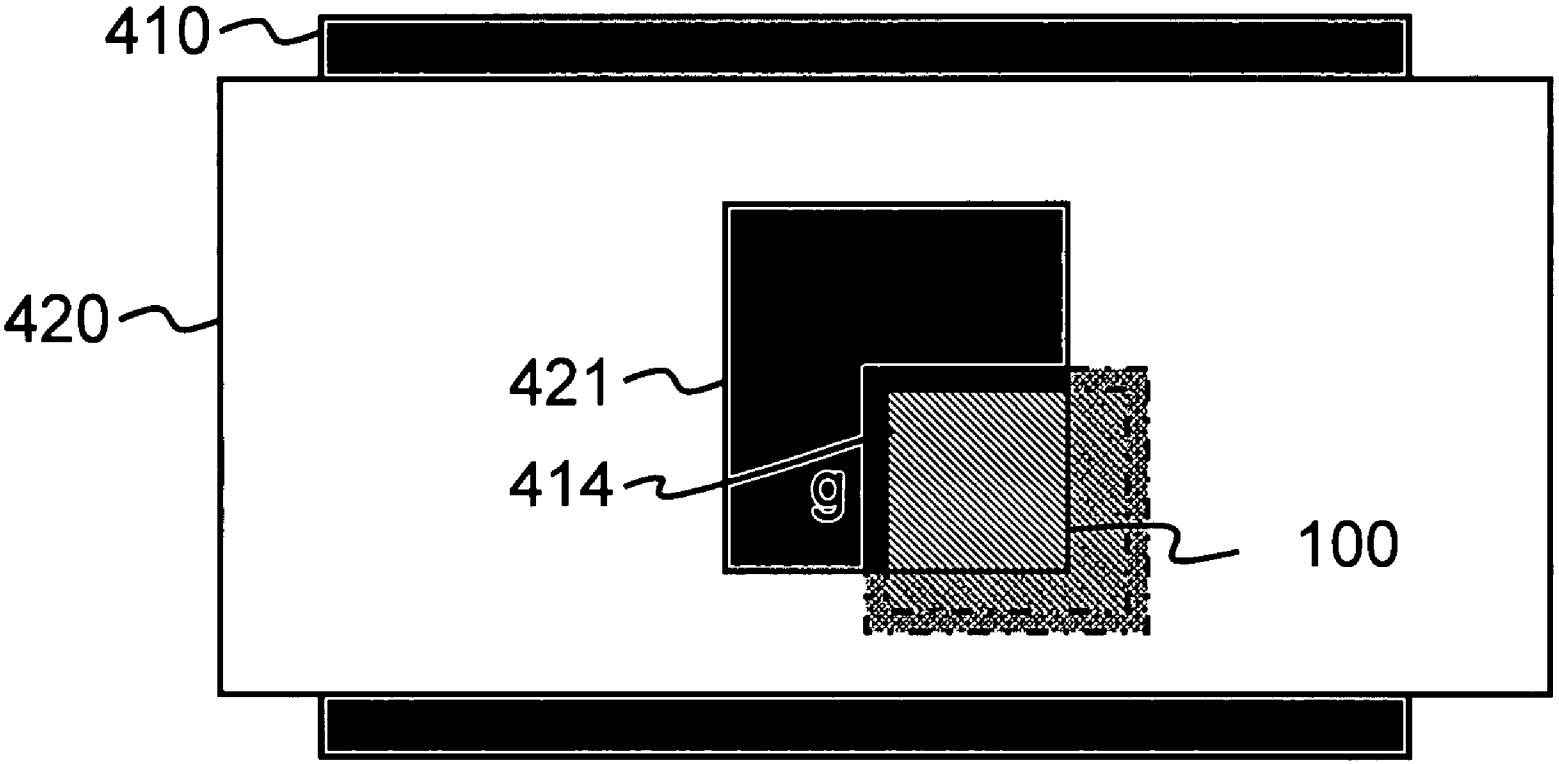
FIG. 5C is an upward view showing a triode field emission display according to a fourth embodiment of the invention.

With reference to FIG. 5C, showing a fourth embodiment of the invention, another case is provided in which the section of the edge of the cathode plate is exposed by exposing the section of the second opening. Comparing with the third embodiment, the section of the second opening 414 and the edge g of the cathode plate 410 surrounded the section of the second opening 414 are exposed at a nook of the first opening 421 of the gate layer 420.

As described above, with respect to the electrical characteristics that the edge structure may raise the electric field intensity, the triode field emission display according to the invention exposes the edge of the cathode plate through the opening of the gate layer to raise the electric field at the emitter. Or, the opening is also disposed at the cathode plate entirely or partially exposing the opening of the cathode plate and the cathode plate surrounded the opening to achieve the same result. That is, according to the invention, only the structure of the cathode is modified without a complex process. A higher electric field is provided for the same gate and anode voltages, thereby reducing the driving voltage substantially and accelerating the development of the driving system.

Certain variations will be apparent to those skilled in the art, and those variations are considered within the spirit and scope of the claimed invention.

What is claimed is:

1. A triode field emission display, comprising:

an insulation substrate;

a cathode plate disposed on the insulation substrate, the cathode plate including:

a cathode electrode layer;

a resistive layer formed on the cathode electrode layer; and an emitter formed on the resistive layer;

a gate layer disposed on the cathode plate, and having a first opening pierced through the gate layer to expose upper surface and side surface of an edge of the emitter of the cathode plate and upper surface of the insulation substrate, so as to induce the cathode plate to excite the electrons from the exposed edge of the emitter of the cathode plate;

a dielectric layer for separating the cathode plate from the gate layer; and an anode plate disposed above the gate layer, so that the excited electrons emit and collide with the anode plate.

2. The triode field emission display of claim 1, wherein the cathode plate comprises a second opening within and through the emitter, the resistive layer and the cathode electrode layer.

3. The triode field emission display of claim 2, wherein the first opening exposes the second opening and the cathode plate surrounding the second opening.

4. The triode field emission display of claim 2, wherein the first opening exposes a section of the second opening and the cathode plate surrounding the outside of the section of the second opening.

5. The triode field emission display of claim 1, wherein the anode plate comprises:

a transparent substrate;

an anode electrode layer formed under the transparent substrate; and a light emitting layer formed under the anode electrode.

6. The triode field emission display of claim 5, wherein the light emitting layer is selected from the group consisting of a fluorescent layer and a phosphorous layer.

7. The triode field emission display of claim 1, wherein the cathode plate, the gate layer and the anode plate are respectively coupled to a first voltage level, a second voltage level, and a third voltage level, and the third voltage level is higher than the first and the second voltage levels.

8. The triode field emission display of claim 1, wherein the emitter is made of a conductive material coated with carbon materials.

9. The triode field emission display of claim 8, wherein the carbon material is selected from the group consisting of a nano carbon material, a diamond, and a diamond-like carbon material.

10. The triode field emission display of claim 1, wherein the gate layer exposes the upper surface of the edge of the emitter of the cathode plate.

11. A triode field emission display, comprising:

an insulation substrate;

a first cathode plate disposed on the insulation substrate, the first cathode plate including:

a first cathode electrode layer disposed on the insulation substrate;

a first resistive layer disposed on the first cathode electrode layer; and a first emitter disposed on the first resistive layer;

a second cathode plate disposed on the insulation substrate, the second cathode plate including:

a second cathode electrode layer disposed on the insulation substrate and separated from the first cathode electrode layer;

a second resistive layer disposed on the second cathode electrode layer, wherein an edge of the second resistive layer facing the first resistive layer overlaps an edge of the second cathode electrode layer facing the first cathode electrode layer; and a second emitter disposed on the second resistive layer, wherein an edge of the second emitter facing the first emitter overlaps the edge of the second resistive layer facing the first resistive layer;

a gate layer disposed on the cathode plate, and having a first opening pierced through the gate layer to expose an edge of the first emitter and the edge of the second emitter which face each other and upper surface of the insulation substrate, so as to induce the cathode plate to excite the electrons from the exposed edges of the first emitter and the second emitter;

a dielectric layer for separating the cathode plate from the gate layer; and an anode plate disposed above the gate layer, so that the excited electrons emit and collide with the anode plate.

12. The triode field emission display of claim 11, wherein the first emitter and the second emitter are connected to a first voltage level, the gate layer is connected to a second voltage level, and the anode plate is connected to a third voltage level, and the first voltage level, the second voltage level and the third voltage level are different.

13. The triode field emission display of claim 12, wherein the second voltage level is higher than the first voltage level and the third voltage level is higher than the first voltage level and the second voltage level.

14. The triode field emission display of claim 12, wherein the anode plate comprises a transparent substrate, an anode electrode layer and a light emitting layer, and the anode electrode layer is connected to the third voltage level.

15. The triode field emission display of claim 11, wherein the emitter is made of a conductive material coated with carbon materials.

16. The triode field emission display of claim 15, wherein the carbon material is selected from the group consisting of a nano carbon material, a diamond, and a diamond-like carbon material.

17. The triode field emission display of claim 11, wherein the gate layer exposes upper surface of the edge of the first emitter and upper surface of the edge of the second emitter.

* * * * *